US005567342A

United States Patent [19]

Inoue et al.

[11] Patent Number: 5,567,342

[45] Date of Patent: Oct. 22, 1996

[54] LUBRICATING OIL COMPOSITION FOR INTERNAL COMBUSTION ENGINES

[75] Inventors: Kiyoshi Inoue; Masakuni Hirata, both of Yokohama, Japan

[73] Assignee: Nippon Oil Co., Ltd., Japan

[21] Appl. No.: 458,438

[22] Filed: Jun. 2, 1995

[30] Foreign Application Priority Data

Jun. 6, 1994 [JP] Japan ..... 6-145727

[51] Int. Cl.[6] ..... C10M 137/06; C10M 133/56

[52] U.S. Cl. ..... 508/287

[58] Field of Search ..... 252/32.7 E

[56] References Cited

U.S. PATENT DOCUMENTS

| | | | |
|---|---|---|---|
| 3,445,386 | 5/1969 | Otto et al. | 252/32.7 E |
| 3,796,662 | 3/1974 | Lyle et al. | 252/32.7 E |
| 3,920,562 | 11/1975 | Foehr | 252/32.7 E |
| 3,933,659 | 1/1976 | Lyle et al. | 252/32.7 E |
| 4,010,107 | 3/1977 | Rothert | 252/32.7 E |
| 4,306,984 | 12/1981 | Yamaguchi | 252/32.7 E |
| 4,375,418 | 3/1983 | Zoleski et al. | 252/32.7 E |
| 4,502,970 | 3/1985 | Schetelich et al. | 252/32.7 E |
| 4,529,526 | 7/1985 | Inoue et al. | 252/32.7 E |
| 5,326,485 | 7/1994 | Cervenka et al. | 252/32.7 E |
| 5,328,620 | 7/1994 | Ripple | 252/32.7 E |

OTHER PUBLICATIONS

Smalheer et al, "Lubricant Additives", p. 1–11, 1967.

*Primary Examiner*—Ellen M. McAvoy

*Attorney, Agent, or Firm*—Ostrolenk, Faber, Gerb & Soffen, LLP

[57] ABSTRACT

An internal combustion engine lubricating oil composition adapted for used with a maintenance-free system of engine and having excellent properties including oxidation stability, resistance against sludge formation and ability to clean the engine. The composition is characterized in that it comprises ingredients (A) through (D) below as essential components on the basis of total amount of composition and the total base number of the composition is between 2.0 and 6.0 mgKOH/g: (A) a specific alkaline earth metal type cleaning agent, (B) zinc dialkyldithiophosphate expressed by a specific general formula (1), (C) a succinic acid imide type ashless dispersant and (D) a phenol type and/or amine type ashless antioxidant.

16 Claims, 2 Drawing Sheets

LUBRICATING OIL COMPOSITION FOR INTERNAL COMBUSTION ENGINES

BACKGROUND OF THE INVENTION

1. Field of the Invention

This invention relates to a lubricating oil composition to be suitably used for internal combustion engines.

2. Background Art

An internal combustion engine (hereinafter referred to simply as engine) of an automobile comprises an oil pan arranged at a lower part of the cylinder block of the engine main body for feeding lubricating oil (hereinafter referred to engine oil) stored in the oil pan to various parts of the engine and causing it to circulate for lubrication.

The engine oil stored in the oil pan needs to be totally replaced in the course of time because it becomes degraded as it is used for lubrication.

According to owner's manuals provided by automobile manufacturers, the engine oil of an automobile typically needs to be replaced for every 15,000 km of mileage at best if engine oil of the highest grade such as API SH grade is used.

Therefore, the automobile owner has to remind him- or herself not to forget about periodical engine oil change, taking the mileage of the car into consideration.

On the other hand, engine oil for stationary gasoline and diesel engines also requires periodic replacement at the cost of time and labor that can significantly raise the running cost of the engine.

In view of these circumstances, various so-called maintenance-free systems have been proposed to reduce the cost and labor of servicing by extending the service life of engine oil as much as possible.

SUMMARY OF THE INVENTION

However, no engine oil has been found to date that meets the requirements of a maintenance-free system including oxidation stability and resistance against sludge formation in order to keep the oil clean and the capability of reducing any possible deposits in the combustion chamber and on the inlet valve.

It is therefore the object of the present invention to provide engine oil having a specific composition and a set of specific properties that can be used for a maintenance-free system to reduce the deposits in the combustion chamber and on the inlet valve and prevent the degradation of the exhaust gas decomposing catalyst of the engine.

According to the invention, the above object is achieved by providing a lubricating oil composition for internal combustion engines comprising a lubricating base oil, (A) a 0.1 to 0.7% by weight of at least an alkaline earth metal type cleaning agent in the form of sulfuric acid ash selected from alkaline earth metal sulfonates, alkaline earth metal phenates and alkaline earth salicylates, (B) a 0.01 to 0.10% by weight in terms of phosphorous atom concentration of a zinc dialkyldithiophosphate expressed by the following general formula (1)

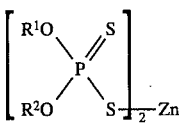

(1)

where $R^1$ and $R^2$ are alkyl groups having 3 to 12 carbon atoms and may be same or different, (C) a 0.05 to 0.20% by weight in terms of nitrogen atom concentration of a succinic acid imide type ashless dispersant and (D) a 0.5 to 3.0% by weight of a phenol and/or amine type ashless antioxidant, as essential components on the basis of the total amount of the composition, wherein the total base number of the composition is between 2.0 and 6.0 mgKOH/g.

DETAILED DESCRIPTION OF THE PREFERRED EMBODIMENTS

Figure 1:
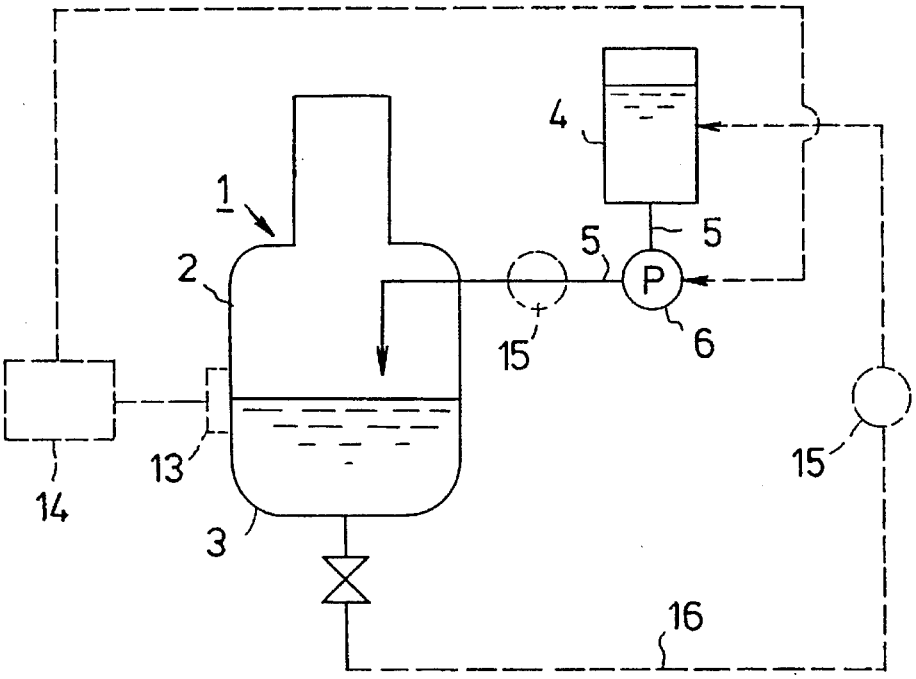
FIG. 1 is a diagrammatic illustration of a maintenance-free engine oil supply system.

Now, a lubricating oil composition for internal combustion engines (engine oil composition) according to the present invention will be described in greater detail.

For the purpose of the invention, no particular limitations are provided for lubricating base oil and may be appropriately selected from various types of mineral oil and synthetic oil that are widely used as engine base oil.

Mineral oils that can be used for the purpose of the present invention include paraffin type and naphthene type base oils produced by refining fractions of lubricating oil obtained as a result of atmospheric distillation and vacuum distillation of crude oil, using a combination of techniques selected from solvent deasphalation, solvent extraction, hydrocracking, solvent dewaxing, catalytic dewaxing, hydrorefining, sulfuric acid treating and clay treating.

Examples of synthetic oil that can be used for the purpose of the invention include α-olefin polymers (polybutenes, octene-1 oligomers, decene-1 oligomers and the like), alkylbenzenes, alkylnaphthalenes, diesters (ditridecyl glutarate, di-2-ethylhexyl adipate, diisodecyl adipate, ditridecyl adipate, di-3-ethylhexyl sebacate and the like), polyol esters (trimethylolpropane caprylate, trimethylolpropane pelargonate, pentaerythritol-2-ethylhexanoate, pentaerythritol pelargonate and the like), polyoxyalkylene glycols, polyphenyl ethers, silicon oils, perfluoroalkyl ethers and mixtures thereof.

Any of these base oils may be used alone or two or more than two of them may be used in combination. Although the base oil to be used for the purpose of the invention may have any kinematic viscosity, an extremely low kinematic viscosity can make the base oil very evaporating and a high oil consumption rate may result, whereas an extremely high kinematic viscosity can result in poor fuel economy. The kinematic viscosity of the base oil is preferably found within a range of about 3 to 20 $mm^2/s$ at 100° C. and more preferably within a range of about 3 and 16 $mm^2/s$ at 100° C.

The component (A) of the oil composition according to the present invention is at least one alkaline earth metal type cleaning agent in the form of sulfuric acid ash selected from alkaline earth metal sulfonates, alkaline earth metal phenates and alkaline earth salicylates.

For the purpose of the invention, the alkaline earth metal sulfonate is one or more than one alkaline earth metal salts of alkyl aromatic sulfonic acid, magnesium salt and/or calcium salt in particular, typically obtained by sulfonating an alkyl aromatic compound having a molecular weight between 300 to 1,500, preferably between 400 and 700 and includes so-called petroleum sulfonic acids and synthetic sulfonic acids.

For the purpose of the present invention, a petroleum sulfonic acid can be obtained by sulfonating an alkyl aromatic compound extracted from the lubricating oil fraction of mineral oil or by using mahogany acid obtained as a by-product of white oil production.

For the purpose of the invention, the synthetic sulfonic acid can be obtained as a by-product of detergent production in an alkylbenzene manufacturing plant or by sulfonating alkylbenzene having a straight chain or branched alkyl groups which is produced by alkylating polyolefin or benzene or also by sulfonating alkylnaphthalene such as dinonylnaphthalene.

While any sulfonating agent may be used for sulfonating the alkyl aromatic compound for the purpose of the invention, the use of fuming sulfuric acid or sulfuric anhydride is most appropriate.

For the purpose of the present invention, the alkaline earth metal phenate is one or more than one alkaline earth metal salts of alkylphenol, alkylphenolsulfide and reaction products of Mannich reaction of alkylphenol, magnesium salt and/or calcium salt in particular, and expressed by the following general formulas (2) through (4);

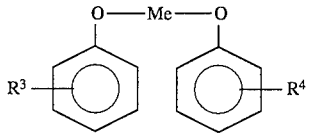

(2)

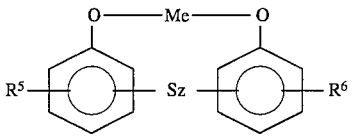

(3)

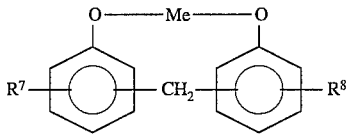

(4)

where $R^3$, $R^4$, $R^5$, $R^6$, $R^7$ and $R^8$ are straight chain or branched alkyl groups having 4 through 30 carbon atoms and may be same or different, Me is one or more than one alkaline earth metal, preferably calcium and/or magnesium and z is an integer of 1 or 2.

For the purpose of the present invention, the salicylate is one or more than one alkaline earth metal salts of alkylsalicylic acid, calcium and/or magnesium salts in particular and expressed by the following general formula (5);

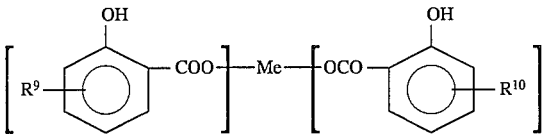

(5)

where $R^9$ and $R^{10}$ are straight chain alkyl groups having 4 through 30 carbon atoms and may be same or different, Me is one or more than one alkaline earth metals, preferably calcium and/or magnesium.

For the purpose of the present invention, the alkaline earth metal sulfonate, alkaline earth metal phenate and alkaline earth metal salicylate include not only alkaline earth metal sulfonates, alkaline earth metal phenates and alkaline earth metal salicylates obtained by causing alkyl aromatic sulfonic acid, alkylphenol, alkylphenol sulfide, reaction products of Mannich reaction of alkylphenol or alkylsalicylic acid to directly react with oxides or hydroxides of alkaline earth metals such as magnesium and/or calcium and neutral (normal salt) alkaline earth metal sulfonates, neutral (normal salt) alkaline earth metal phenates and neutral (normal salt) alkaline earth metal salicylates obtained by replacing the alkali metals such as sodium and potassium with alkaline earth metals of corresponding comparable compounds but also basic alkaline earth metal sulfonates, basic alkaline earth metal phenates and alkaline earth metal salicylates obtained by heating neutral alkaline earth metal sulfonates, neutral alkaline earth metal phenates and neutral alkaline earth metal salicylates along with excessive alkaline earth metal salts and alkaline earth metal bases in the presence of water and overbasic (superbasic) alkaline earth metal salicylates, overbasic (superbasic) alkaline earth metal phenates and overbasic (superbasic) alkaline earth metal salicylates obtained by causing neutral alkaline earth metal sulfonates, neutral alkaline earth metal phenates and neutral alkaline earth metal salicylates to react with alkaline earth metal bases in the presence of carbonic acid gas.

For the component (A), neutral alkaline earth metal salts, basic alkaline earth metal salts, overbasic (super-basic) alkaline earth metal salts and mixtures thereof may be used.

The content of the component (A) is between a lower limit of 0.1% and an upper limit of 0.7% by weight and preferably between a lower limit of 0.2% and an upper limit of 0.6% by weight in terms of sulfuric acid ash on the basis of the total amount of the composition. The piston cleaning effect of the composition will not be satisfactory if the content goes under 0.1% by weight and the deposit in the combustion chamber appears at an excessive rate if the content exceeds 0.8% by weight. The sulfuric acid ash is preferably tested by a method conforming to JIS K2272.

For the purpose of the present invention, the component (B) is a zinc dialkyldithiophosphate expressed by the general formula (1) as shown above.

In the formula, $R^1$ and $R^2$ denote alkyl groups having 3 to 12 and preferably 3 to 8 carbon atoms and may be same or different. The alkyl groups may be of the primary type or of the secondary type.

Examples of the component (B) include zinc diisopropyldithiophosphate, zinc diisobutyl-dithiophosphate, zinc di-sec-butyl-dithiophosphate, zinc diisoamyl-dithiophosphate, di-4-methylpentyl-dithiophosphate, zinc di-2-ethylhexyl-dithiophosphate, zinc diisodecyl-dithiophosphate, zinc di-dodecylphenyl-dithiophosphate and mixtures thereof.

The content of the component (B) is between a lower limit of 0.01% and an upper limit of 0.10% and preferably between a lower limit of 0.02% and an upper limit of 0.08% by weight in terms of phosphorus atom concentration. The oxidation stability of the composition will become too low if the content goes under 0.1% by weight and the exhaust gas decomposing catalyst of the engine can be degraded if the content exceeds 0.10% by weight.

For the purpose of the present invention, the component (C) is a succinic acid imide type ashless dispersant. Although no particular conditions are provided for the material of the component (C), examples of materials that can be used for it include at least a succinic acid imide type ashless dispersant selected from compounds expressed by the following general formulas (6) or (7), compounds obtained by modifying compounds expressed by the following general formula (6) by means of inorganic acid such as boric acid or organic acid such as oxalic acid and compounds obtained by modifying compounds expressed by the general formula (7) by means of inorganic acid such as boric acid or organic acid such as oxalic acid.

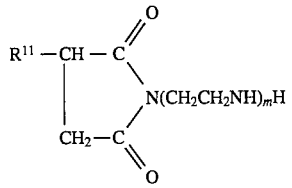

(6)

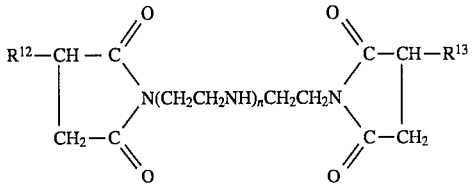

(7)

where $R^{11}$, $R^{12}$, and $R^{13}$ are alkyl groups or alkenyl groups, preferably polybutenyl groups or ethylene-propylene copolymer groups having an average molecular weight of 900 to 5,000 and preferably 900 to 3,500 and may be same of different and m and n are integers between 2 and 5.

The component (C) can be obtained by causing polyolefin such as polybutene or ethylene-propylene copolymer to react with maleic anhydride and thereafter with polyamine such as tetraethylenepentamine.

The content of the component (C) is between a lower limit of 0.05% and an upper limit of 0.20% and preferably between a lower limit of 0.06% and an upper limit of 0.15% by weight in terms of nitrogen atom concentration on the basis of the total amount of the composition. The piston cleaning effect of the composition will not be satisfactory if the content goes under 0.05% by weight and the cold fluidity of the composition becomes too low if the content exceeds 0.20% by weight.

For the purpose of the present invention, the component (D) is a phenol type and/or amine type ashless antioxidant.

Examples of compounds that can be used for the component (D) include 2,6-di-t-butylphenol, 2,6-di-t-butyl-p-cresol, 2,6-di-t-butyl-4-ethylphenol, 2,2'-methylenebis(4-methyl-6-t-butylphenol), 2,2'-methylene-bis(4-ethyl-6-t-butylphenol), 4,4'-methylenebis(2,6-di-t-butylphenol), 4,4'-bis(2,6-di-t-butylphenol), 4,4'-thiobis(6-t-butyl-o-cresol), tridecyl alcohol ester of 3-(4-hydroxy-3,5-di-t-butyl-phenyl-)propionic acid, octadecyl alcohol ester of 3-(4-hydroxy-3,5-di-t-butyl-phenyl)propionic acid and other phenol type ashless antioxidants, diphenylamine, p,p'-dioctyldiphenylamine, p,p'-didodecyldiphenylamine, phenyl-α-naphthylamine, p-octylphenyl-α-naphtylamine, p-nonylphenyl-α-naphthylamine, p-dodecylphenyl-α-naphthylamine and other amine type ashless antioxidants and mixtures thereof.

The content of the component (D) is between a lower limit of 0.5% and an upper limit of 3.0% and preferably between a lower limit of 0.6% and an upper limit of 2.0% by weight in terms of nitrogen atom concentration on the basis of the total amount of the composition. The oxidation stability of the composition will become too low if the content goes under 0.5% by weight and the piston cleaning effect of the composition will not be satisfactory if the content exceeds 3.0% by weight.

A lubricating oil composition for internal combustion engines according to the present invention comprises the above components (A) through (D) as essential additives by the specifically defined respective contents and, in addition, shows a total base number between 2.0 and 6.0 mgKOH/g when determined by means JIS K2501 (hydrochloride method). The cleaning effect of the composition will not be satisfactory and the degradation of the composition will start in early stages if the total base number is lower than 2.0 mgKOH/g.

While a lubricating oil composition for internal combustion engines according to the present invention may show oxidation stability to any extent, the oxidation induction time of the composition is preferably longer than 120 minutes and more preferably longer than 150 minutes when determined by ASTM D4742 (Oxidation Stability Test).

Any known other additives may be added to an engine oil composition according to the invention in order to further enhance its performance.

Examples of additives that can suitably be used for the purpose of the invention include extreme-pressure agents such as tricresylphosphate and triphenylphosphate, rust-preventives, metal deactivators such as benzotriazole, ashless dispersants such as succinate and benzylamine, defoaming agents such as silicon, viscosity index enhancers such as polymethacrylate, polyisobutylene, polystyrene and pour point depressants and two or more than two of these additives may be used in combination.

For the purpose of the invention, the typical contents of the viscosity index enhancer, the defoaming agent and the metal deactivator will be respectively between 1 and 30% by weight, between 0.005 and 1% by weight and between 0.1 and 15% by weight on the basis of the total amount of the composition.

A lubricating oil composition according to the present invention can suitably be used for gasoline engines of motor cycles and automobiles, diesel engines of motor vehicles and vessels, stationary gasoline engines and stationary diesel engines particularly in the maintenance-free system of such engines.

No particular conditions are provided for a maintenance-free supply system that can be used for the purpose of the present invention. Such a system may typically have a configuration as shown in FIG. 1.

FIG. 1 shows an apparatus for supplying a lubricating oil composition for internal combustion engines that comprises a reservoir tank 4 arranged at a lower portion of the cylinder block of 2 the engine main body 1 for storing lubricating oil and supplying it at a predetermined rate to the engine and an oil pan 3 which is a section for temporarily storing lubricating oil that is being fed and made to circulate from the reservoir tank to the engine at a predetermined rate along with a lubricating oil feeding means for driving lubricating oil to flow toward the oil pan (hereinafter referred to as apparatus I). The lubricating oil feeding means include an oil feed pipe 5 communicating the bottom of the reservoir tank and the oil pan 3 and a quantifying pump 6 fitted to the feed pipe 5.

While the reservoir tank 4 of the apparatus I can store either fresh oil or recycle oil, fresh oil is preferable for the purpose of the invention. Recycle oil is prepared by collecting oil from the lubricating oil from the section for temporarily storing lubricating oil, separating impurities by filtering and centrifugalizing it and using additives.

As described above, the apparatus I supplies a lubricating oil composition at a predetermined rate, which may be either a fixed rate determined on the basis of the average oil consumption rate and the capacity of the engine or a variable rate that varies depending on the load applied to the oil. If a variable rate that varies depending on the load applied to the oil is adopted, the rate of supplying lubricating oil to the engine is determined as a function of the state of operation of the engine.

The operation of this system will be described hereinafter.

The apparatus I may additionally comprises means for regularly or irregularly, preferably regularly, checking the volume of lubricating oil stored in the section for temporarily storing lubricating oil and compensate the lost lubricating oil with oil in the reservoir tank 4. The regular checking may be conducted after a predetermined time of operation or a predetermined mileage of the engine. As indicated by the broken lines in FIG. 1, a lubricating oil level sensor 13 transmits a signal to a control section 14, which control section 14 then transmits a control signal to the quantifying pump to feed a required volume of lubricating oil.

The apparatus I may be provided with a filter 15 to remove any insoluble substances in the lubricating oil. If such is the case, the filter 15 is arranged on an oil feed pipe 5 connecting the reservoir tank 4 and lubricating oil storage section 3, on a lubricating oil path (not shown) connecting the lubricating oil storage section 3 and the engine or, if recycle oil is used, on an lubricating oil path 16 connecting the lubricating oil storage section 3 and the reservoir tank 4. Alternatively, two or more than two filters may be arranged.

Figure 2:
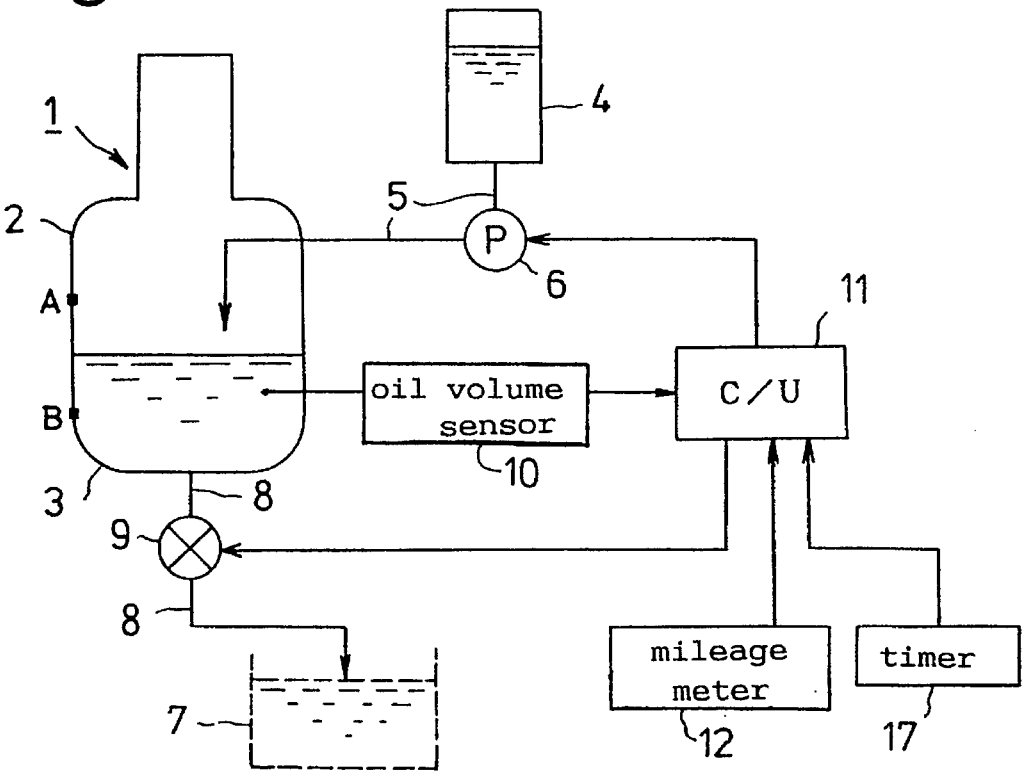
FIG. 2 is a diagrammatic illustration of another maintenance-free engine oil supply system.

FIG. 2 shows a modified maintenance-free supply system to an internal combustion engine lubricating oil composition according to the invention. This modified system is realized by providing the above apparatus I with an arrangement where high level A and low level B are defined in the lubricating oil storage section 3 for supplying lubricating oil after a predetermined time of operation or a predetermined mileage of the engine such that the oil in the storage section is drawn out from it each time lubricating oil is supplied to the engine until the level of the oil falls to level B and fresh oil is then supplied to the high level A from the reservoir tank 4 until it gets to high level A.

With this arrangement, the timer 17 transmits a signal to the control unit 11 whenever a predetermined time of operation passes or the mileage meter 12 transmits a signal to the control unit 11 whenever a predetermined mileage is observed and then the level of the oil in the oil pan is detected by the oil level sensor 11 arranged in the lubricating oil storage section 3. If the level is higher than low level B, the oil in the lubricating oil storage section 3 is drawn out through the oil drain pipe 8 until the level gets to low level B. The drawn out oil may be stored in a waste oil tank 7 or, alternatively, returned to the reservoir tank 4 by way of the filter 15 as shown in FIG. 1. Thereafter, the control unit 11 transmits a signal to the quantifying pump 6, which then supply fresh oil from the reservoir tank 4 to the lubricating oil storage section 3 until the oil level sensor 10 detects that the level of the oil in the lubricating oil storage section 3 is in high level A.

Again, this modified system may be provided with a filter 15 to remove any insoluble substances in the lubricating oil. If such is the case, the filter 15 may be arranged at the location shown in FIG. 1.

Figure 3:
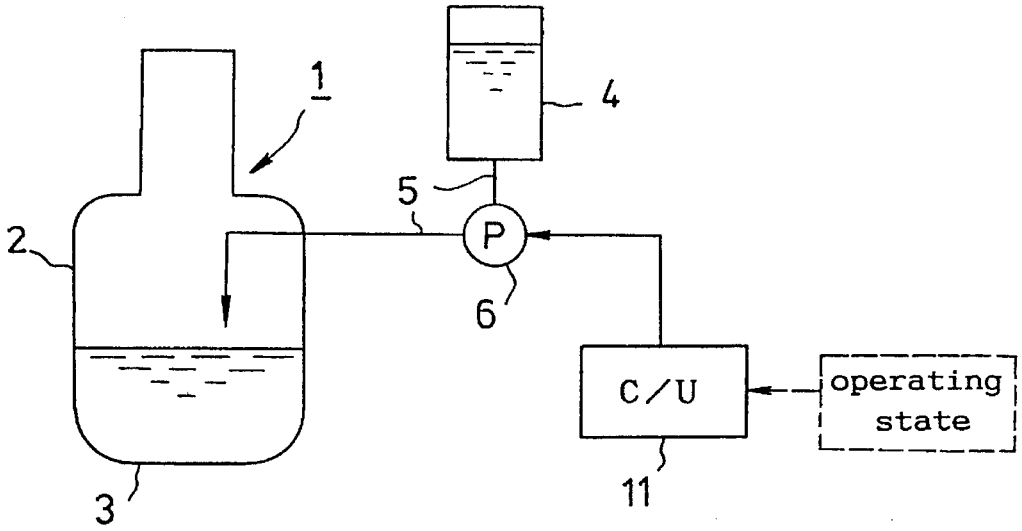
FIG. 3 is a diagrammatic illustration of still another maintenance-free engine oil supply system.

FIG. 3 shows another modified maintenance-free supply system to an internal combustion engine lubricating oil composition according to the invention. This modified system is realized by providing the above apparatus I with control means for controlling said supply means for supplying the lubricating oil storage section 3 with a predetermined amount of fresh oil from the reservoir tank 4 when the internal combustion engine is operating (hereinafter referred to as apparatus II).

The control means may comprise a sensor (not shown) for detecting the state of operation of the engine, e.g., high speed operation and low speed operation and a control unit 11 as well as other appropriate component. With this system, the output signal of the sensor is sent to the control unit 11, which by turn transmits a control signal to the quantifying pump 6 so that a predetermined volume of fresh oil is fed to the lubricating oil storage section 3 from the reservoir tank 4 on a regular basis depending on the state of operation of the engine.

With this arrangement, lubricating oil can have a prolonged service life and can be relieved of maintenance to a considerable extent so that, if used for a stationary gasoline or diesel engine, it can greatly save time and labor and reduce the running cost.

Figure 4:
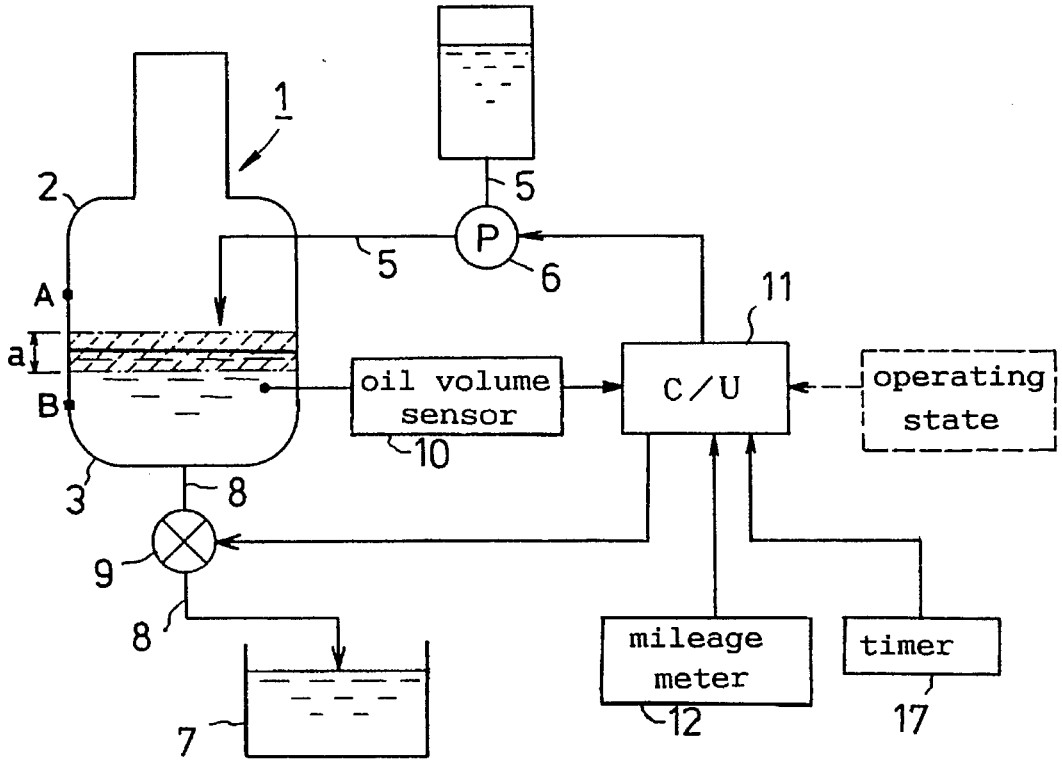
FIG. 4 is a diagrammatic illustration of a further maintenance-free engine oil supply system.

FIG. 4 shows still another modified maintenance-free supply system comprising supply means for supplying the lubricating oil storage section 3 with means for supplying the lubricating oil storage section 3 with a predetermined amount of fresh oil from the reservoir tank 4 on a regular basis. In modified system, the above described apparatus II is further provided with drain means for draining lubricating oil from the lubricating oil storage section 3 (comprising an oil drain pipe 3, a solenoid valve 9 controlled by the signal transmitted from the control unit 11, a waste oil tank 7 and other components) and detection means for detecting the volume of oil in the lubricating oil storage section 3 (comprising an oil volume sensor for detecting the volume of oil in the oil pan 3 and other components), said control means being designed to control the supply means and the drain means according to the detection signal transmitted from the oil volume detection means periodically when the internal combustion engine is operating (said modified apparatus being referred to as apparatus III hereinafter).

Lubricating oil stored in the lubricating oil storage section of the apparatus III is gradually lost as a result of evaporation and combustion. So, the oil in the oil pan 3 is monitored and the lubricating oil storage section 3 is supplied with lubricating oil or oil is drawn out of the storage section 3 until the oil in the lubricating oil storage section 3 gets to control level a whenever a predetermined time of operation passes (and a signal is transmitted from the timer 17) or when a predetermined mileage is observed (and a signal is transmitted from the mileage meter 12).

More specifically, if the lubricating oil in the lubricating oil storage section 3 is below control level a as a result of monitoring, lubricating oil is supplied to the lubricating oil storage section 3 from the reservoir tank 4 until it gets to control level a. To the contrary, if the oil in the oil pan 3 is found above control level a as a result of monitoring, a necessary amount of oil is drawn out of the lubricating oil storage section 3. If the oil in the lubricating oil storage section 3 goes under low level B or exceeds high level A before a predetermined time passes, then the lubricating oil storage section 3 is supplied with lubricating oil or drained immediately.

The apparatus II or III preferably comprises engine state detection means for detecting the operating state of the engine so that said control means controls the volume of lubricating oil to be supplied to the lubricating oil storage section 3 according to the detection signal transmitted from said engine state detection means and representing the operating state of the engine.

The operating state of engine as used here is a function of the number of revolution per unit time of the engine, the oil temperature, the boost pressure of the air inlet, the duration of operation of the engine and other factors, which are detected by corresponding individual detection means so that the control means of the control unit 11 controls the volume to be supplied to the oil pan 3 according to the detection signals transmitted from the respective detection means in such a way that said volume always reflects the operating state of the engine (in terms of the number of revolution per unit time of the engine, the oil temperature, the boost pressure of the air inlet, the duration of operation of the engine and other factors.

With the above described arrangement, the volume of oil to be supplied can be controlled as a function of the load applied to the oil in the system to prolong the service life of the oil.

If a subtank (not shown) is provided as a lubricating oil storage section as an engine oil storage area apart from the oil pan 3, the reservoir tank 4 may supply lubricating oil not to the oil pan 3 but to the subtank when the engine is in operation.

By using an lubricating oil composition according to the invention with any of the above described apparatuses, the service life of oil can be significantly prolonged and the deposit in the combustion chamber and the inlet valve can be greatly reduced. Additionally, the load applied to the filter for removing insoluble substances in oil can be largely lessened and possible degradation of the exhaust gas decomposing catalyst can be significantly prevented.

EXAMPLES

Now, the present invention will be described further by way of examples and comparative examples, although they do not limit the scope of the invention by any means.

EXAMPLE AND COMPARATIVE EXAMPLE

Example and comparative example of oil composition containing the ingredients and their respective contents as listed in Table 1 were evaluated by a stage-engine test. The test results (the amounts of piston head deposits) are also shown in Table 1.

| | |
|---|---|
| Engine: | 1.5 $dm^3$, OHC-type |
| Fuel: | leadless high octane value gasoline (not containing engine cleaner) |
| Test Mode: | AMA mode |
| Test hours: | 500 h |
| Oil Management: | Test was started from Low Level of the level gauge and oil was supplied every 24 hours until it got to Low Level in an assumed maintenance-free system. |

TABLE 1

| | | Exmpl. | Cmpr. Exmpl. |
|---|---|---|---|
| (A) | overbasic calcium sulfonate[1)] (wt %) | 0.78 | 1.56 |
| | calcium sulfide phenate[2)] (wt %) | 0.80 | 0.80 |
| (B) | zinc dialkyldithiophosphate[3)] (wt %) | 0.60 | 1.20 |
| (C) | polybuthenylsuccinic acid imide[4)] (wt %) | 6.50 | 5.50 |
| (D) | phenol type antioxidant[5)] (wt %) | 0.50 | 0.50 |
| | amine type antioxidant[6)] (wt %) | 0.60 | 0.20 |
| Others | viscosity index enhancing agent[7)] (wt %) | 2.44 | 2.44 |
| | friction modifier[8)] (wt %) | 0.40 | 0.40 |
| | base oil[9)] (wt %) | 87.38 | 87.40 |
| total sulfuric acid ash content of (A) (on the basis of total amount of composition) (wt %) | | 0.47 | 0.80 |
| phosphorous atom concentration of (B) (on the basis of total amount of composition) (wt %) | | 0.043 | 0.086 |
| nitrogen atom concentration of (C) (on the basis of total amount of composition) (wt %) | | 0.091 | 0.077 |
| total base number (hydrochloride method)[10)] (mgKOH/g) | | 3.8 | 6.2 |
| oxidation induction time[11)] (min) | | 165 | 160 |
| amount of piston head deposit (average of 4 pistons) (g) | | 0.27 | 1.91 |

N.B.:
[1)]overbasic calcium salt of alkylbenzensulfonic acid - total base number of 320 mgKOH/g determined with a method according to JIS K2501 (hydrochloride method)
[2)]calcium salt of alkyldodecylsulfide - total base number or 135 mgKOH/g determined with a method according to JIS K2501 (hydrochloride method)
[3)]mixed system of secondary type alkyl groups having 4 to 6 carbon atoms for alkyl groups
[4)]mixture of mono- and bis-types obtained by reacting succinic acid with tetraethylenepentamine and having polybutenyl groups with average molecular weight of 1,300
[5)]4,4'-methylenebis(2,6-di-t-butylphenol)
[6)]diakyldiphenylamine type; mixed system of tert-butyl groups and tert-octyl groups for alkyl groups
[7)]mixed system of dispersion type polymethacrylate-olefin copolymer
[8)]ester system
[9)]highly refined mineral oil - kinematic viscosity of 4 $mm^2/s$ (@100° C.), viscosity index 100
[10)]determined with a method according to JIS K2501 (hydrochloride method)
[11)]determined with a method according to ASTM D4742

ADVANTAGES OF THE INVENTION

When an engine oil composition according to the invention is used with a maintenance-free system for engines, it shows properties required for the system to a satisfactory extent, including oxidation stability and resistance against sludge formation and can remarkably clean the engine. In other words, it can reduce the deposit in the combustion chamber and the inlet valve and prevent possible degradation of the exhaust gas decomposing catalyst.

What is claimed is:

1. A lubricating oil composition for internal combustion engines characterized in that it comprises: a lubricating base oil, (A) a 0.1 to 0.7% by weight of at least one alkaline earth metal type cleansing agent in the form of sulfuric acid ash selected from alkaline earth metal sulfonate, alkaline earth metal phenate and alkaline earth salicylate, (B) a 0.01 to 0.10% by weight in terms of phosphorous atom concentration of zinc dialkyldithiophosphate expressed by the following general formula (1)

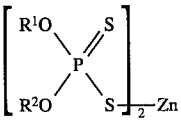

(1)

where $R^1$ and $R^2$ are alkyl groups having 3 to 12 carbon atoms and may be same or different, (C) a 0.05 to 0.15% by weight in terms of nitrogen atom concentration of a succinic acid imide type ashless dispersant and (D) a 0.5 to 3.0% by weight of a phenol or amine type ashless antioxidant, or both, as essential components on the basis of the total amount of the composition, the total base number of the composition being between 2.0 and 6.0 mgKOH/g.

2. A lubricating oil composition according to claim 1 in which the content of component (A) is at least 0.2% by weight.

3. A lubricating oil composition according to claim 1 in which the content of component (A) is up to 0.6% by weight.

4. A lubricating oil composition according to claim 1 in which the content of component (B) is at least 0.02% by weight in terms of phosphorous atom concentration.

5. A lubricating oil composition according to claim 1 in which the content of component (B) is up to 0.08% by weight in terms of phosphorous atom concentration.

6. A lubricating oil composition according to claim 1 in which the content of component (C) is at least 0.06% by weight in terms of nitrogen atom concentration.

7. A lubricating oil composition according to claim 6 in which the content of component (A) is 0.2% to 0.6% by weight and the content of (B) is 0.02% to 0.08% by weight in terms of phosphorous atom concentration.

8. A lubricating oil composition according to claim 7 in which the content of component (D) is 0.06% to 2% by weight.

9. A lubricating oil composition according to claim 8 in which the alkaline earth metal is calcium or manganese.

10. A lubricating oil composition according to claim 9 in which $R^1$ and $R^2$ each have 3–8 carbon atoms and the lubricating base oil has a kinematic viscosity of about 3–20 $mm^2/s$ at 100° C.

11. A lubricating oil composition according to claim 10 in which the base oil has a kinematic viscosity of 3–16 $mm^2/s$ at 100° C. and the composition additionally contains between 1% and 30% by weight of viscosity index enhancer, between 0.005% and 1% by weight of defoaming agent and between 0.15 and 15% by weight of metal deactivator.

12. A lubricating oil composition according to claim 11 in which component (A) is a combination of an overbasic calcium sulfonate and calcium sulfide phenate and component (B) is a combination of a phenol type antioxidant and an amine type antioxidant.

13. A lubricating oil composition according to claim 12 in which the calcium sulfide phenate is a calcium salt of an alkyldodecylsulfide, the alkyl groups of the zinc dialkyldithiophosphate are secondary alkyl groups of 4–6 carbon atoms, the succinic acid imide is a polybuthenylsuccinic acid imide, the phenol-type anti-oxidant is 4,4'-methylene bis(2,6-di-tert-butylphenol) and the amine-type anti-oxidant is a dialkyldiphenol amine in which the alkyl groups are different.

14. A lubricating oil composition according to claim 1 in which the content of component (D) is 0.06% to 2% by weight.

15. A lubricating oil composition according to claim 14 in which the alkaline earth metal is calcium or manganese.

16. A lubricating oil composition according to claim 1 in which the alkaline earth metal is calcium or manganese.

* * * * *